US009243583B2

(12) United States Patent
Hirsch

(10) Patent No.: US 9,243,583 B2
(45) Date of Patent: Jan. 26, 2016

(54) PISTON FOR AN INTERNAL COMBUSTION ENGINE

(75) Inventor: Markus Alexander Hirsch, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 14/347,684

(22) PCT Filed: Sep. 14, 2012

(86) PCT No.: PCT/DE2012/000920

§ 371 (c)(1),
(2), (4) Date: Apr. 8, 2014

(87) PCT Pub. No.: WO2013/044897

PCT Pub. Date: Apr. 4, 2013

(65) Prior Publication Data

US 2014/0238333 A1 Aug. 28, 2014

(30) Foreign Application Priority Data

Sep. 28, 2011 (DE) ..... 10 2011 115 639

(51) Int. Cl.
*F02F 3/00* (2006.01)
*F02F 3/02* (2006.01)

(52) U.S. Cl.
CPC ..... *F02F 3/0069* (2013.01); *F02F 3/00* (2013.01); *F02F 3/02* (2013.01)

(58) Field of Classification Search
CPC ..... F02F 3/00; F02F 3/0069; F02F 3/02
USPC ..... 123/193.3, 193.6, 193.1
See application file for complete search history.

(56) References Cited

U.S. PATENT DOCUMENTS 1,788,668 A 1/1931 Ford
4,856,417 A 8/1989 Ishikawa (Continued)

FOREIGN PATENT DOCUMENTS

DE 38 85 765 T2 6/1994
DE 43 26 978 A1 2/1995

(Continued)

OTHER PUBLICATIONS

International Search Report of PCT/DE2012/000920, mailed Jan. 21, 2013.

(Continued)

*Primary Examiner* — Lindsay Low
*Assistant Examiner* — Long T Tran
(74) *Attorney, Agent, or Firm* — Collard & Roe, P.C.

(57) ABSTRACT

A piston for an internal combustion engine has shaft elements which have inner surfaces that correspond to those regions of the shaft elements in which the shaft elements are thinner than 7% of the piston diameter "D", and have outer surfaces that define in a radially outward direction those regions of the shaft elements which, viewed in the circumferential direction, lie outside angle ranges of more than 40° on both sides of the pin bore axis. The ratio of the content of the inner surface to the ratio of the content of the outer surface is more than 60%. The shaft elements hereby become elastically compliant, which upon a temperature-induced radial expansion of the piston shaft reduces the pressure that the shaft elements exert on the cylindrical inner wall, whereby the friction losses of the piston, and hence the $CO_2$ emission of the engine fitted are reduced.

5 Claims, 2 Drawing Sheets

(56) References Cited

U.S. PATENT DOCUMENTS

Figure 1:
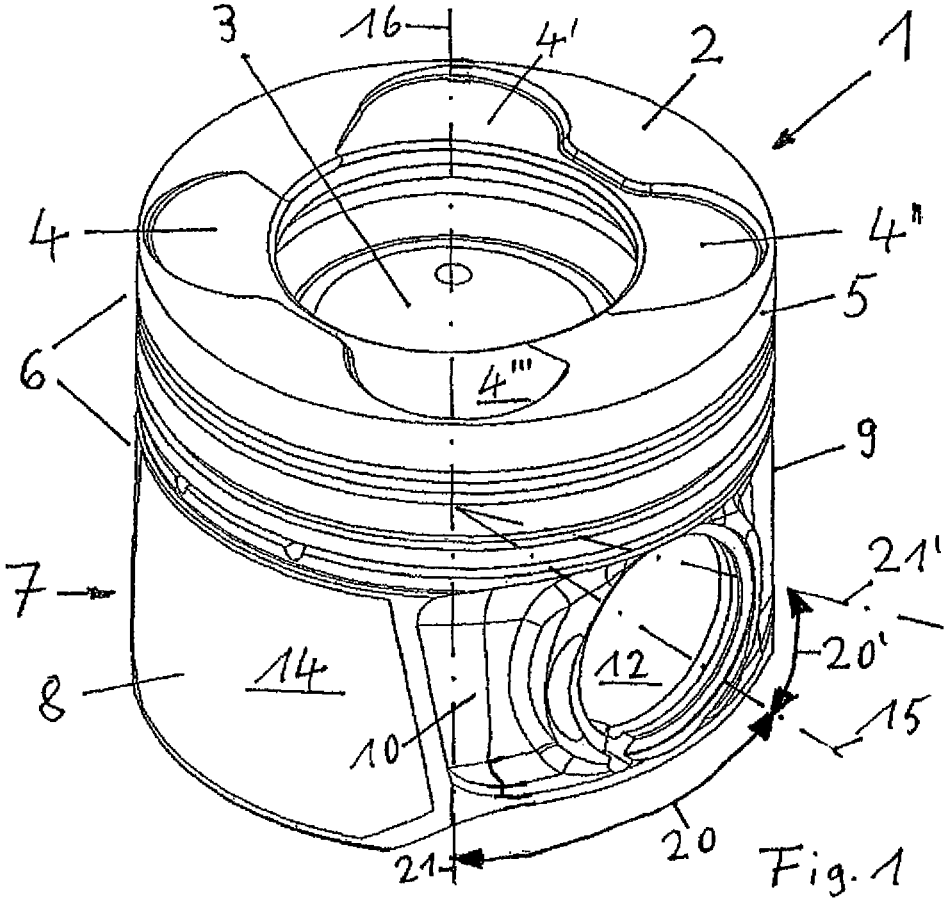

| | | | | | |
|---|---|---|---|---|---|
| 4,941,440 | A * | 7/1990 | Weber | F02B 23/0696 | 123/193.6 |
| 5,076,225 | A * | 12/1991 | Tokoro | F02F 3/00 | 123/193.1 |
| 5,487,364 | A * | 1/1996 | Takeda | F02F 3/00 | 123/193.6 |
| 5,605,126 | A | 2/1997 | Hofmann et al. | | |
| 5,682,808 | A * | 11/1997 | Nakada | F16J 1/02 | 123/193.6 |
| 6,152,017 | A * | 11/2000 | Harrer | F02F 3/00 | 92/208 |
| 6,164,261 | A * | 12/2000 | Kruse | F02F 3/0023 | 123/193.6 |
| 6,240,828 | B1 * | 6/2001 | Fujimoto | F02F 3/02 | 92/214 |
| 6,526,871 | B1 * | 3/2003 | Zhu | F02F 3/003 | 92/208 |
| 6,892,689 | B2 | 5/2005 | Bischofberger et al. | | |
| 7,493,850 | B2 * | 2/2009 | Donahue | F02F 3/02 | 92/208 |
| 7,506,575 | B2 * | 3/2009 | Donahue | F16J 1/04 | 92/208 |
| 2008/0245229 | A1 | 10/2008 | Buschbeck et al. | | |
| 2010/0147251 | A1 * | 6/2010 | Blau | F02F 3/00 | 123/193.6 |
| 2011/0048365 | A1 * | 3/2011 | Schneider | F02F 3/003 | 123/193.6 |

FOREIGN PATENT DOCUMENTS

| | | | |
|---|---|---|---|
| DE | 10 2005 042 857 | A1 | 3/2007 |
| DE | 10 2006 029 040 | A1 | 1/2008 |
| DE | 602 20 925 | T2 | 2/2008 |
| DE | 10 2008 006 854 | A1 | 8/2009 |
| EP | 0 050 257 | A1 | 4/1982 |
| WO | 02/50414 | A1 | 6/2002 |

OTHER PUBLICATIONS

German Search Report dated Jun. 3, 2013 in German Application No. 10 2011 115 639.2 with English translation of relevant parts of same.

* cited by examiner

PISTON FOR AN INTERNAL COMBUSTION ENGINE

CROSS REFERENCE TO RELATED APPLICATIONS

This application is the National Stage of PCT/DE2012/000920 filed on Sep. 14, 2012 which claims priority under 35 U.S.C. §119 of German Application No. 10 2011 115 639.2 filed on Sep. 28, 2011, the disclosure of which is incorporated by reference. The international application under PCT article 21(2) was not published in English.

The invention relates to a piston for an internal combustion engine, having a piston crown followed radially on the outside by a ring belt and a piston skirt, wherein the piston skirt consists of two skirt elements that lie opposite one another, which border on pin bosses, each having a pin bore.

A piston of the type indicated initially is known from the Offenlegungsschrift [unexamined patent application published for public scrutiny] DE 4326978. It is disadvantageous, in this connection, that the skirt elements are configured very massively in the region of the ring belt, so that in the event of a temperature-related, radial expansion of the piston, stresses occur between cylinder wall and piston skirt, which stresses increase the pressure of the skirt elements on the inner cylinder wall, so that the friction power losses are increased and, as a result of this, the $CO_2$ emission of the engine equipped with the known piston is increased.

It is the task of the invention to avoid these disadvantages of the state of the art and to create a piston having reduced $CO_2$ emission.

This task is accomplished in that the skirt elements have inner surfaces, which delimit those regions of the skirt elements, radially inward, in which the skirt elements are thinner than 7% of the piston diameter "D", that the skirt elements have outer surfaces, which, viewed in the circumference direction, delimit those regions of the skirt elements, radially outward, that lie outside of angle regions that lie on both sides of the pin bore axis, wherein the angle regions are delimited by the pin bore axis and by straight lines that stand perpendicular on the piston axis and intersect the piston bore axis, which lines, viewed in the circumference direction, lie on both sides of the pin bore axis, and form an angle of more than 40° with the pin bore axis, in each instance, and that the ratio of the contents of the inner surfaces to the ratio of the contents of the outer surfaces amounts to more than 60%.

In this way, the result is achieved that the skirt elements are configured to be elastically resilient, to such an extent that they give way in the event of a temperature-related, radial expansion of the piston, thereby causing the pressure of the skirt elements on the inner cylinder wall, the friction power losses during engine operation and thereby also the $CO_2$ emission of the engine equipped with the piston according to the invention to be reduced.

Advantageous embodiments of the invention are the object of the dependent claims.

Figure 2:
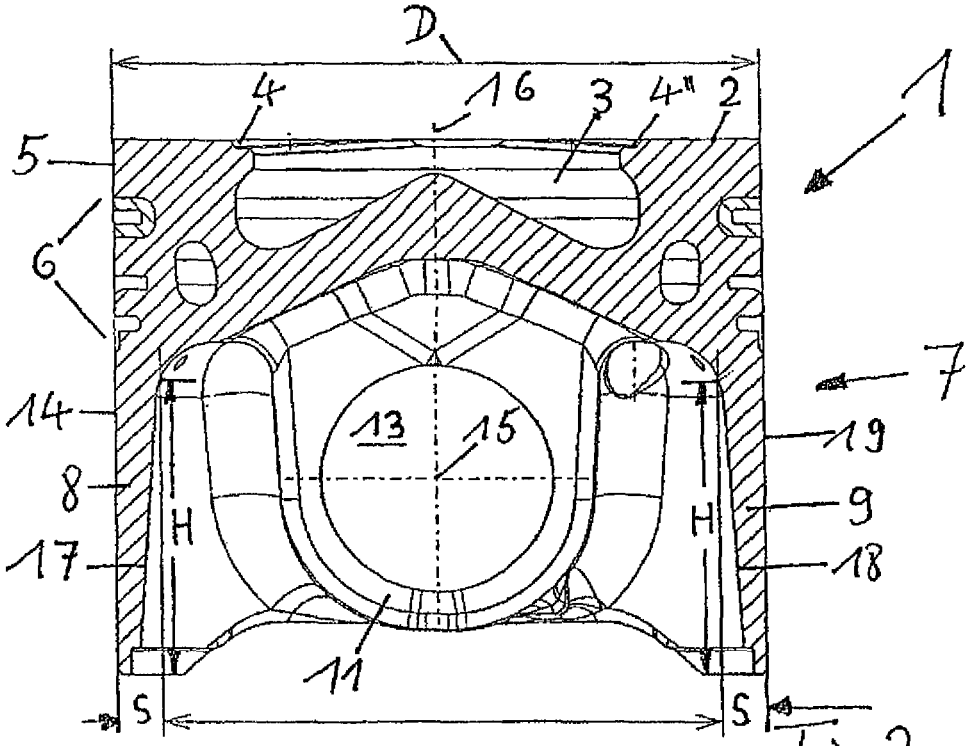
Figure 3:
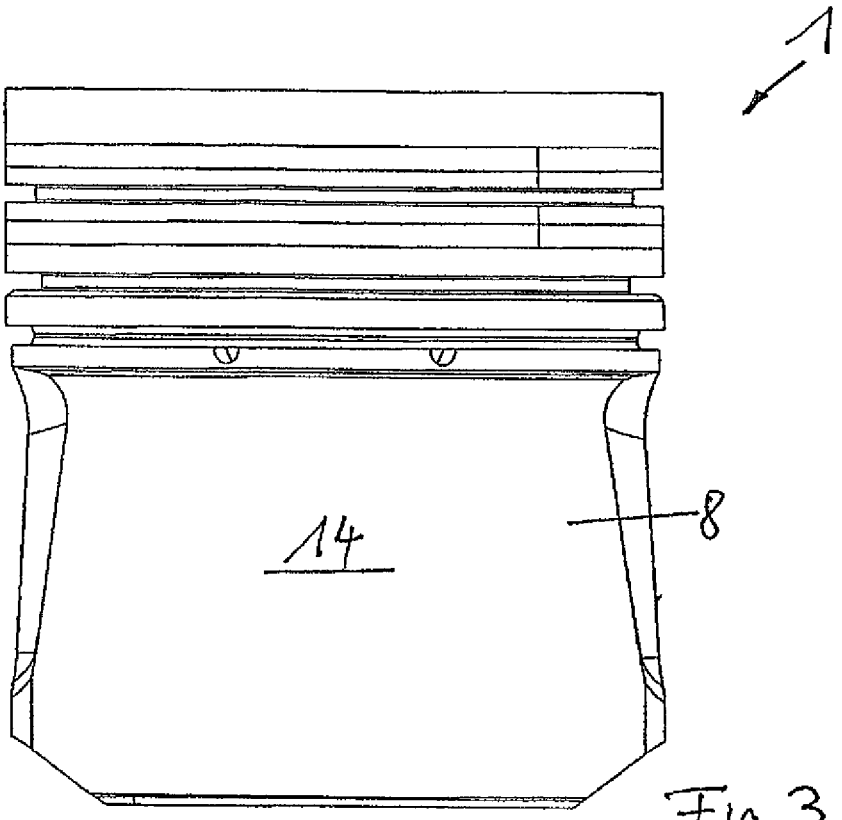
Figure 4:
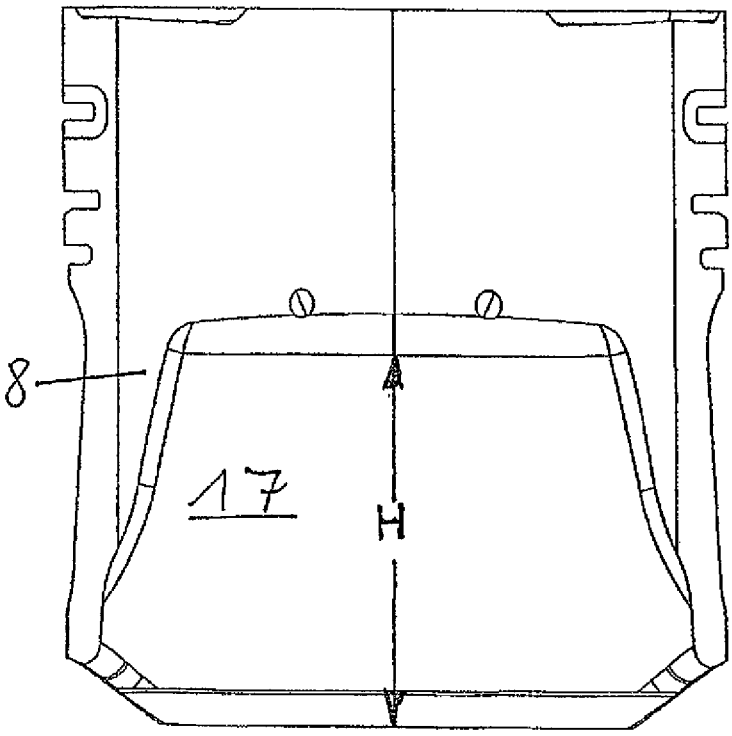

An exemplary embodiment of the invention will be described below, using the drawings. These show:

FIG. 1 the perspective representation of a piston for a diesel engine according to the invention, FIG. 2 a section through the piston according to FIG. 1 along a plane that lies perpendicular to the pin bore axis and on the piston axis, FIG. 3 a side view of the piston, with a representation of the outer surface of a skirt element, and FIG. 4 an inside view of the skirt element.

FIG. 1 and FIG. 2 show a piston 1 for a diesel engine made of aluminum, into the piston crown 2 of which a combustion bowl 3 and four valve pockets 4, 4', 4", 4'" are formed. Radially on the outside, the piston crown 2 is followed by a top land 5, a ring belt 6, and a piston skirt 7. The piston skirt 7 consists of two skirt elements 8 and 9 that lie opposite one another, which border on pin bosses 10, 11, each having a pin bore 12, 13. The outer surface 14 of the skirt element 8 can be seen well in FIG. 1.

In FIG. 1, straight lines 21, 21' are drawn in as auxiliary lines; these stand perpendicular on the piston axis 16 and intersect the pin bore axis 15, and are disposed, viewed in the circumference direction, on both sides of the pin bore axis 15, and delimit the angle regions 20, 20' that lie on both sides of the pin bore axis 15, which angle regions are greater than 40° and correspond to the regions of the pin bosses 10, 11 that lie outside of the surfaces of the skirt elements 14, 19.

FIG. 2 shows the piston 1 in section along a plane that lies perpendicular to the pin bore axis 15 and on the piston axis 16. The skirt elements 8, 9, shown in section, have a cross-section having a radial diameter that decreases toward the lower end that faces away from the piston crown. At the upper end of the inner surfaces 17, 18, having the length "H" of the skirt elements 8 and 9, which corresponds to the maximal axial length of the inner surfaces 17, 18 (see FIG. 4), the thickness "S" of the skirt elements 8 and 9 corresponds to 7% of the piston diameter "D" and decreases constantly downward. In this connection, the maximal thickness "S" of the skirt elements 8, 9 in the region of the inner surfaces 17, 18 must be less than 7% of the piston diameter "D".

FIG. 3, a side view of the piston 1, shows the outer surface 14 of the skirt element 8, while FIG. 4 shows the inner surface 17 of the skirt element 8, whereby the surface 17 is equivalent to the region of the skirt element 8 in which the skirt element 8 is thinner than 7% of the piston diameter "D". The ratio of the content of the surface 17 to the content of the surface 14 lies at more than 60%, preferably between 65% and 78%, and this also holds true for the ratio of the content of the inner surface 18 to the content of the outer surface 19 of the skirt element 9. The size ratio of the inner surface 17, 18 to the outer surface 14, 19 of the skirt elements, according to the invention, can, accordingly, be found in the skirt element of the major thrust side and in the skirt element of the minor thrust side, in other words in both skirt elements.

During engine operation, the outer surfaces 14, 19 of the skirt elements 8, 9 particularly lie against the wall of a cylinder bushing of an internal combustion engine, whereby during engine operation, contact forces occur in the skirt elements 8, 9, because of the greater radial thermal expansion of the piston 1 as compared with the comparatively lesser radial thermal expansion of the cylinder bushing that consists of an iron material, so that the skirt elements 8, 9 are pressed against the inner surface of the cylinder bushing with an increasing force, as heating increases, by way of their outer surfaces 14, 19, and this increases the friction power losses of the piston 1 during engine operation and thereby also the $CO_2$ emission of the engine.

In order to reduce this force and thereby the friction power losses and the $CO_2$ emission of the engine, the skirt elements are dimensioned as described above, which brings about the result that the skirt elements are configured to be more elastic, so that they give way to the temperature-related expansion of the piston, thereby reducing the force with which the skirt elements press onto the inner cylinder surface, and thereby reducing the friction power losses during engine operation and thereby ultimately also the $CO_2$ emission of the internal combustion engine.

In this connection, attention must be paid to ensure that guidance of the piston in the cylinder is not impaired, and for this reason, the elastically resilient regions of the skirt elements created on the basis of the dimensional foundation described above are not too large.

In general, the piston shape is structured in such a manner that the hard skirt part, the thickness of which is greater than 7% of the piston diameter, is allowed so much play that this play is sufficient so that this region of the hard skirt part does not experience any direct pressure stresses by way of the contact between piston and cylinder when the piston expands due to temperature.

In order to furthermore guarantee the guidance of the piston in the cylinder, the soft skirt part must amount to at least 60% of the total skirt.

REFERENCE SYMBOL LIST

H, D, S dimension
1 piston
2 piston crown
3 combustion bowl
4, 4', 4", 4'" valve pocket
5 top land
6 ring belt
7 piston skirt
8, 9 skirt element
10, 11 pin boss
12, 13 pin bore
14 outer surface of the skirt element 8
15 pin bore axis
16 piston axis
17 inner surface of the skirt element 8
18 inner surface of the skirt element 9
19 outer surface of the skirt element 9
20, 20' angle region
21, 21' straight line

The invention claimed is:

1. A piston for an internal combustion engine, having a piston crown followed radially on an outside by a ring belt and a piston skirt, wherein the piston skirt consists of two skirt elements that lie opposite one another, which border on pin bosses, each pin boss having a pin bore with a pin bore axis, wherein the piston consists of aluminum, wherein the skirt elements have inner surfaces, which delimit radially inward regions of the skirt elements, and which extend to a height H of the skirt elements, wherein a thickness of the skirt elements in the region of the inner surfaces is less than 7% of a piston diameter "D", wherein the skirt elements have outer surfaces, which, viewed in the circumference direction, delimit radially outward regions of the skirt elements, wherein the outer surfaces of the skirt elements lie outside of angle regions that lie on both sides of the pin bore axis, wherein the angle regions are delimited by the pin bore axis and by straight lines that stand perpendicular to the piston axis and intersect the piston bore axis, said lines, viewed in the circumference direction, lying on both sides of the pin bore axis, and each forming an angle of more than 40° with the pin bore axis, wherein the region of the skirt elements that have a thickness of less than 7% of the piston diameter are configured to lie against a wall of a cylinder bushing of the internal combustion engine, wherein regions of the skirt elements that are outside the regions having a thickness of less than 7% of the piston diameter are configured to be free from direct pressure stresses from the cylinder during engine operation, and wherein the area of the inner surfaces is more than 60% of the area of the outer surfaces.

2. The piston according to claim 1, wherein the area of the inner surfaces is more than 65% of the area of the outer surfaces.

3. The piston according to claim 1, wherein the area of the inner surfaces is more than 72% of the area of the outer surfaces.

4. The piston according to claim 1, wherein the area of the inner surfaces is more than 78% of the area of the outer surfaces.

5. A combination piston and cylinder for an internal combustion engine, comprising:

a cylinder having an internal bushing, an aluminum piston disposed in the cylinder, the piston comprising a piston crown followed radially on an outside by a ring belt and a piston skirt, wherein the piston skirt consists of two skirt elements that lie opposite one another, which border on pin bosses, each pin boss having a pin bore with a pin bore axis, wherein the skirt elements have inner surfaces, which delimit radially inward regions of the skirt elements, and which extend to a height H of the skirt elements, wherein a thickness of the skirt elements in the region of the inner surfaces is less than 7% of a piston diameter "D", wherein the skirt elements have outer surfaces, which, viewed in the circumference direction, delimit radially outward regions of the skirt elements, wherein the outer surfaces of the skirt elements lie outside of angle regions that lie on both sides of the pin bore axis, wherein the angle regions are delimited by the pin bore axis and by straight lines that stand perpendicular to the piston axis and intersect the piston bore axis, said lines, viewed in the circumference direction, lying on both sides of the pin bore axis, each forming an angle of more than 40° with the pin bore axis, wherein the area of the inner surfaces is more than 60% of the area of the outer surfaces, wherein the regions of the skirt elements having a thickness of less than 7% of the diameter of the piston are configured to lie against a wall of the cylinder bushing and are pressed against the wall during engine operation, and wherein the areas of the piston skirt outside of the regions of the skirt elements having a thickness of less than 7% of the piston diameter are not subject to direct pressure stresses by the cylinder during operation.

* * * * *